US008453765B2

(12) United States Patent
Haughom

(10) Patent No.: US 8,453,765 B2
(45) Date of Patent: Jun. 4, 2013

(54) APPARATUS FOR DIRECTIONAL CONTROL OF A DRILLING TOOL

(75) Inventor: Per Olav Haughom, Tonstad (NO)

(73) Assignee: 2TD Drilling AS, Algard (NO)

( * ) Notice: Subject to any disclaimer, the term of this patent is extended or adjusted under 35 U.S.C. 154(b) by 256 days.

(21) Appl. No.: 12/665,132

(22) PCT Filed: Jun. 18, 2008

(86) PCT No.: PCT/NO2008/000224

§ 371 (c)(1),
(2), (4) Date: May 4, 2010

(87) PCT Pub. No.: WO2008/156375

PCT Pub. Date: Dec. 24, 2008

(65) Prior Publication Data

US 2010/0236830 A1 Sep. 23, 2010

(30) Foreign Application Priority Data

Jun. 20, 2007 (NO) ..... 20073136

(51) Int. Cl.
*E21B 7/04* (2006.01)

(52) U.S. Cl.
USPC ..... 175/73; 175/55

(58) Field of Classification Search
USPC ..... 175/73, 74, 76
See application file for complete search history.

(56) References Cited

U.S. PATENT DOCUMENTS

| | | | | |
|---|---|---|---|---|
| 5,353,884 | A * | 10/1994 | Misawa et al. | 175/26 |
| 5,875,859 | A | 3/1999 | Ikeda et al. | |
| 6,092,610 | A | 7/2000 | Kosmala et al. | |
| 6,494,272 | B1 | 12/2002 | Eppink et al. | |
| 6,892,830 | B2 * | 5/2005 | Noe et al. | 175/61 |
| 2002/0175003 | A1 * | 11/2002 | Pisoni et al. | 175/74 |
| 2004/0262043 | A1 | 12/2004 | Schuaf | |
| 2006/0090935 | A1 | 5/2006 | Van Steenwyk et al. | |
| 2008/0041629 | A1 * | 2/2008 | Aronstam et al. | 175/61 |
| 2008/0066958 | A1 * | 3/2008 | Haci et al. | 175/27 |

FOREIGN PATENT DOCUMENTS

| | | | |
|---|---|---|---|
| EP | 1 857 631 | A1 | 11/2007 |
| GB | 2 434 60 1 | A | 8/2007 |
| GB | 2 450 498 | A | 12/2008 |

OTHER PUBLICATIONS

Great Britain Examination Report for corresponding British Patent Application No. 1000542.9 mailed Apr. 13, 2011.

Norwegian Search Report for corresponding Norwegian Patent Application No. 20073136 mailed Dec. 3, 2007.

* cited by examiner

*Primary Examiner* — Giovanna Wright
*Assistant Examiner* — Ronald Runyan

(57) ABSTRACT

A directional-control apparatus for a drilling tool, in which the direction of the drilling tool during the drilling of a borehole is controlled by means of at least one steering body which is moved radially against the wall of the borehole, the movement of the at least one steering body relative to the center axis of the directional-control apparatus being adjustable in order to steer the drilling tool in a desired direction and at a desired deflection, and at least one electrically operated actuator being connected via at least one set of transmission elements to the at least one steering body and arranged to move the at least one steering body into a position relative to the center axis of the directional-control apparatus, the relative position having the effect that the drilling tool is steered in the desired direction and at the desired deflection.

5 Claims, 5 Drawing Sheets

IIa–IIa

IIb–IIb

APPARATUS FOR DIRECTIONAL CONTROL OF A DRILLING TOOL

This application is a National Stage Application of PCT/NO2008-000224, filed 18 Jun. 2008, which claims benefit of Serial No. 20073136 filed 20 Jun. 2007 in Norway and which applications are incorporated herein by reference. To the extent appropriate, a claim of priority is made to each of the above disclosed applications.

This invention relates to a directional-control apparatus for a drilling tool. More particularly, it relates to a directional-control apparatus for a drilling tool in which the direction of the drilling tool during the drilling of a borehole is controlled by means of at least one steering body which is moved radially against the wall of the borehole. The movement of the at least one steering body relative to the centre axis of the directional-control apparatus is adjustable with respect to steering the drilling tool in a desired direction and at a desired deflection. At least one electric actuator is connected via at least one set of transmission elements to the at least one steering body and is arranged to move the at least one steering body into a position relative to the centre axis of the directional-control apparatus, the relative position of the at least one steering body causing the drilling tool to be steered in the desired direction and at the desired deflection.

During drilling in the ground as it is known from the recovery of petroleum among other things, it is often necessary to be able to steer the drilling tool in a desired direction. For example, so-called deviation wells are drilled with considerable deviation from the vertical direction.

During drilling in the ground it is common to use a drill bit which is connected to a pipe string, the pipe string and drill bit being rotated about their longitudinal axes by a drilling device at the surface.

According to the prior art, the directional control of the drilling tool may be exerted by applying to the drill bit a radial force which is arranged to make the drill bit drill at some deflection in a desired direction relative to its centre axis. Instrumentation at the drill bit in the form of at least a gyroscope, an accelerometer, or a magnetometer, enables feedback on the position of the drill bit in the ground.

U.S. patent application 2006/0090935 discloses a number of bodies which are arranged in an intermediate piece between the drill bit and the pipe string, the bodies being manoeuvred by means of hydraulic pistons. Transducers measure the positions of the respective pistons, hydraulic valves being used to control the pressure on the bodies, whereby the radial force from the bodies against the borehole wall has the effect of steering the drill bit in the desired direction. Thus, the device according to U.S. 2006/0090935 is relatively complicated with relatively many valves which will be sensitive and which are supplied with drilling fluid under pressure as the operating means.

The invention has for its object to remedy or to reduce at least one of the drawbacks of the prior art.

The object is achieved through features which are specified in the description below and in the claims that follow.

A directional-control apparatus in accordance with the invention for the directional control of a drilling tool, in which the direction of the drilling tool during drilling is controlled by means of at least one steering body which is moved radially against the borehole wall, and in which the movement of the at least one steering body relative to the centre axis of the directional-control apparatus is adjustable with respect to steering the drilling tool in a desired direction and at a desired deflection. The directional-control apparatus according to the invention is characterized by at least one electric actuator being connected via at least one set of transmission elements to the at least one steering body and being arranged to move the at least one steering body into a position relative to the centre axis of the directional-control apparatus, the relative position having the effect that the drilling tool is moved in the desired direction and at the desired deflection.

The at least one electric actuator is typically supplied with energy via a wire connection to the surface, but it may also be supplied with energy from a local accumulator or a drilling-fluid-operated generator, for example. The actuator may communicate with the surface via known communication methods.

With advantage, the first electric actuator is connected to the at least one steering body via a first set of transmission elements and arranged to move the at least one steering body into a position relative to the centre axis of the directional-control apparatus, the relative position having the effect that the drilling tool is steered at the desired deflection, and a second electric actuator being connected via a second set of transmission elements to the at least one steering body and arranged to move the at least one steering body into a position relative to the centre axis of the directional-control apparatus, the relative position having the effect that the drilling tool is steered in the desired direction.

The directional-control apparatus, including, in a manner known per se, an intermediate housing, is positioned between the drill bit and pipe string of the drilling tool immediately behind the drill bit.

With advantage, the intermediate housing is rotating freely in relation to the pipe string and is thereby not co-rotating with the pipe string during drilling. A mandrel, which is connected to the pipe string and to the drill bit, extends centrically through the intermediate housing, transferring torque and drilling fluid, among other things.

In a preferred embodiment the directional-control apparatus includes a number of steering bodies which are spaced around the intermediate housing, and which are movable in a radial direction relative to the centre axis of the directional-control apparatus and, thereby, that of the drilling tool. An inner eccentric sleeve is rotatably supported around the mandrel and is surrounded by an outer eccentric sleeve. The outer eccentric sleeve and the inner eccentric sleeve have equal differences between their respective largest and smallest external radii. The external cylinder surface of the outer eccentric sleeve is thereby concentric with the centre axis of the directional-control apparatus when the largest radius of the eccentric sleeve is at 180 degrees relative to the largest radius of the internal eccentric sleeve.

When the steering bodies are to be moved in a particular direction in order to change the direction of drilling of the drill bit, the outer eccentric sleeve is rotated by means of the first actuator until the steering bodies have been given a desired displacement. The internal eccentric sleeve is rotated together with the outer eccentric sleeve until the largest diameter of the outer eccentric sleeve is in the desired direction relative to the centre axis of the apparatus. This direction is normally diametrically opposite the direction in which the drill bit is to be steered.

The electric actuators may, with advantage, be constituted by electric motors. The actuators may be provided with positioners of a design known per se.

Electrical control and actuation of the at least one steering body of the directional-control apparatus lead to the directional-control apparatus being independent of hydraulic fluid, whether in the form of drilling fluid, which may exhibit relatively great pressure variations, or from a local fluid reservoir with the necessary pump equipment. Thus, the invention provides a substantial simplification in relation to the prior art devices for the directional control of a drilling tool.

In what follows, is described an example of a preferred embodiment which is visualized in the accompanying drawings, in which.

Figure 1:
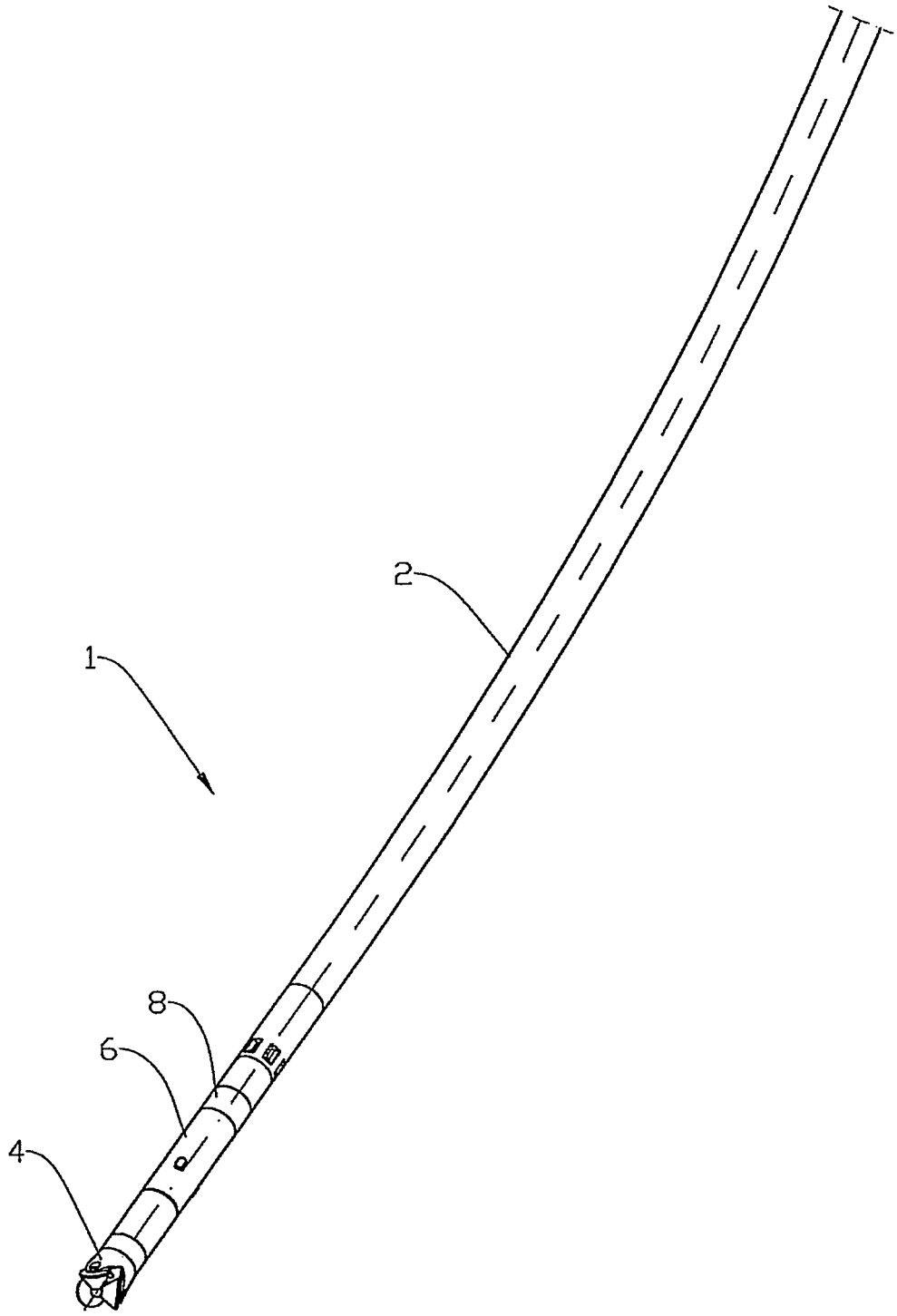
FIG. 1 shows a drilling tool including a pipe string and a drill bit and also a directional-control apparatus in accordance with the invention.
Figure 2:
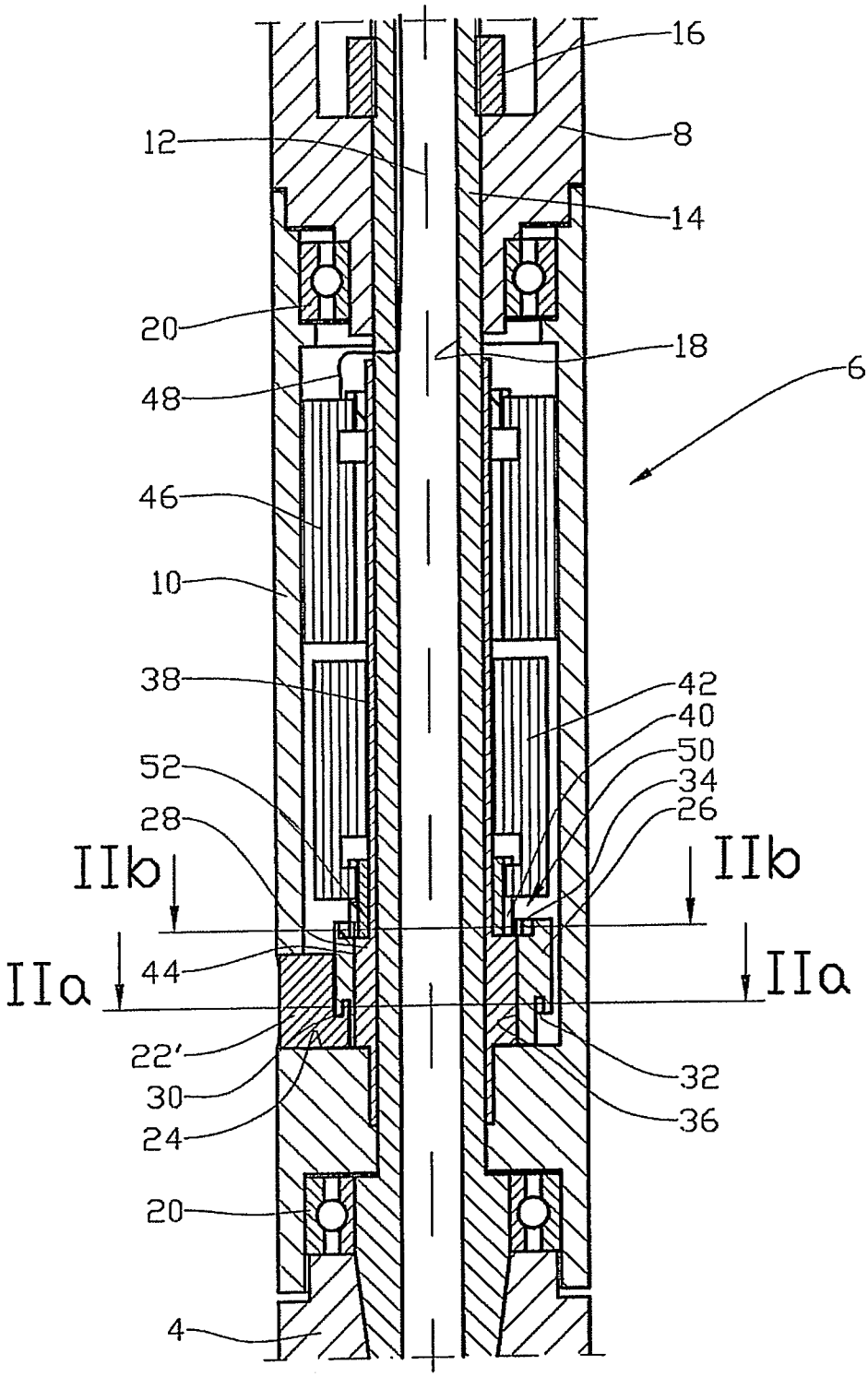
FIG. 2 shows, on a larger scale, a longitudinal section of the directional-control apparatus according to FIG. 1.

In the drawings the reference numeral 1 denotes a drilling tool which includes a drill string 2 and also a drill bit 4, and in which there is installed between the pipe string 2 and the drill bit 4 a directional-control apparatus 6 by means of an adapter sleeve 8.

The directional-control apparatus 6 includes an intermediate housing 10 with a centre axis 12 and a concentric through mandrel 14. The mandrel 14 is sealingly connected, at its one end portion, to the drill bit 4 and sealingly connected, at its opposite end portion, to the pipe string 2 by means of the adapter sleeve 8. A nut 16 holds the mandrel 14 in position in the adapter sleeve 8.

The mandrel 14 is provided with a centric bore 18 extending through it for drilling fluid to flow through from the pipe string 2 to the drill bit 4. The intermediate housing 10 is connected to the mandrel 14 via bearings 20 and rotates freely about the mandrel 14.

Figure 3:
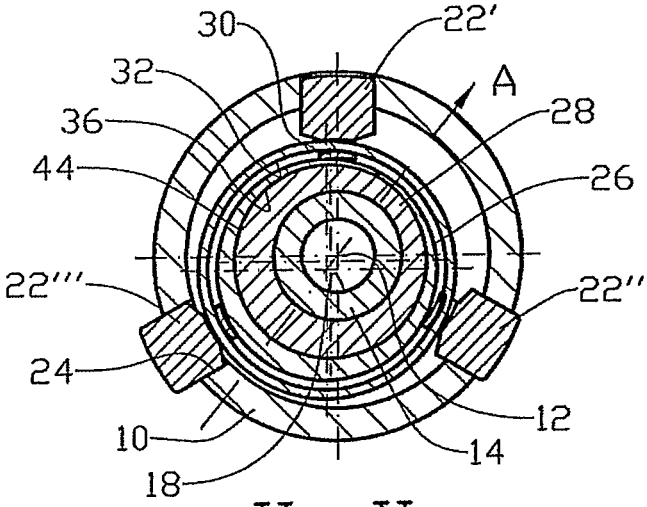
FIG. 3 shows, on a somewhat further enlarged scale, a section IIa-IIa of FIG. 2, in which the directional-control apparatus steers the drilling tool in a direction A.

A first steering body 22', a second steering body 22" and a third steering body 22''', see FIG. 3, are spaced, radially movable, at preferably equal divisions around the intermediate housing 10.

The steering bodies 22', 22", 22''' are cylinder-shaped, fitting complementarily into their respective bores 24 in the intermediate housing 10.

At their end portions facing the centre axis 12, the steering bodies 22', 22", 22''' bear on an outer eccentric sleeve 26, the outer eccentric sleeve 26 being rotatably supported around an inner eccentric sleeve 28. The outer eccentric sleeve 26 and the inner eccentric sleeve 28 have equal differences between their respective largest and smallest external radii.

A hook 30 in each of the steering bodies 22', 22", 22''' projects axially relative to the centre axis 12 into a groove 32 surrounding the outer eccentric sleeve 26. Thereby, the steering bodies 22', 22", 22''' are prevented from being moved inadvertently out of the intermediate housing 10.

In its end portion facing away from the drill bit 4, the outer eccentric sleeve 26 is provided with an internal gear rim 34 which is concentric with the inner jacket surface 36 of the outer eccentric sleeve 26.

The inner eccentric sleeve 28 supportedly and rotatably surrounds the mandrel 14, an extension sleeve 38, connected to the inner eccentric sleeve 28, projecting axially from the end portion of the inner eccentric sleeve 28 facing away from the drill bit 4.

A gear 40 supportingly surrounding the extension sleeve 38 complementarily matches the gear rim 34 and is connected to a first electric motor forming a first electrically operated actuator 42. The first actuator 42 is attached to the extension sleeve 38, co-rotating therewith. The first actuator 42 is arranged to rotate the outer eccentric sleeve 26 around the inner eccentric sleeve 28.

The engagement of the gear 40 with the gear rim 34 remains satisfactory even if the centre of the gear rim 34 is moved about the centre axis 12 when the inner eccentric sleeve 28 is rotated, as the centre of the gear rim 34 coincides with the centre of the external jacket 44 of the inner eccentric sleeve 28.

The extension sleeve 38 is connected to a second electric motor forming a second electrically operated actuator 46. The second actuator 46 is attached to the intermediate housing 10. Thereby, the second, actuator 46 is arranged to rotate the extension sleeve 38 with the inner eccentric sleeve 28 relative to the intermediate housing 10.

The actuators 42, 46 are supplied with energy and control signals via a wire connection 48 extending to the surface.

The outer eccentric sleeve 26 and the gear 40 form a first set of transmission elements 50, whereas the inner eccentric sleeve 28 with the extension sleeve 38 forms a second set of transmission elements 52.

Figure 4:
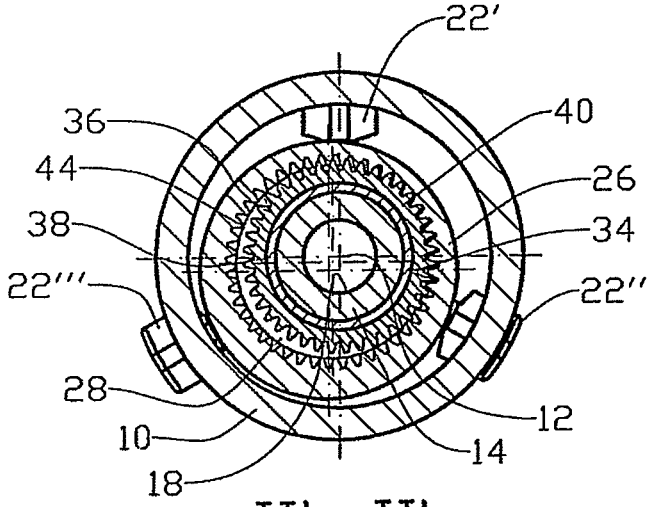
FIG. 4 shows a section IIb-IIb of FIG. 2 under the same conditions as those of FIG. 3.
Figure 5:
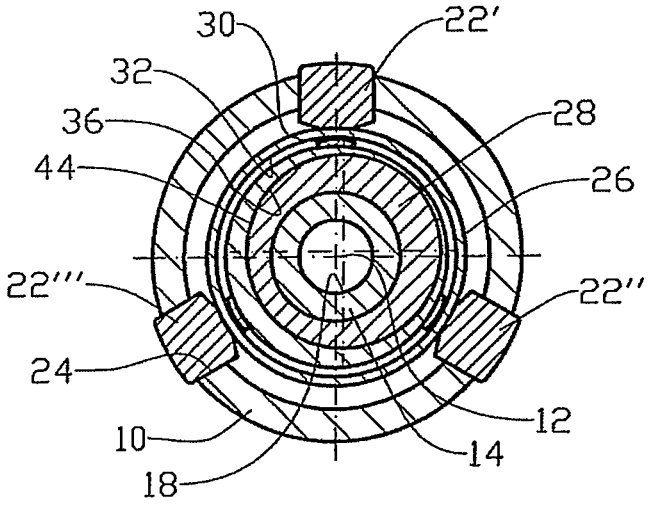
FIG. 5 shows the section IIa-IIa of FIG. 2, but after the directional-control apparatus has been adjusted into a neutral position.
Figure 6:
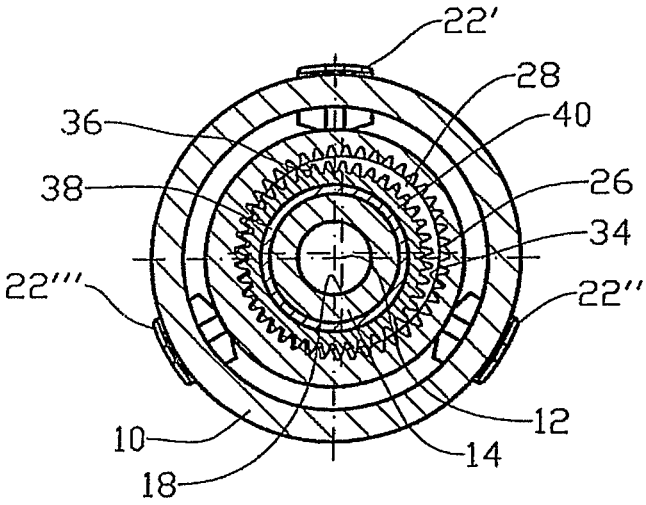
FIG. 6 shows the section IIb-IIb of FIG. 2 under the same conditions as those of FIG. 5.

By rotating the outer eccentric sleeve 26 about the inner eccentric sleeve 28 by means of the first actuator 42, the outer eccentricity of the outer eccentric sleeve 26 relative to the centre axis 12 may be adjusted between zero and full deflection. In FIGS. 3 and 4 the outer eccentric sleeve 26 is approximately at full deflection, whereas in FIGS. 5 and 6 it is shown in a concentric position relative to the centre axis 12. Thus, the first actuator 42 is used to control the displacement or admission of the steering bodies 22', 22", 22'''.

Figure 7:
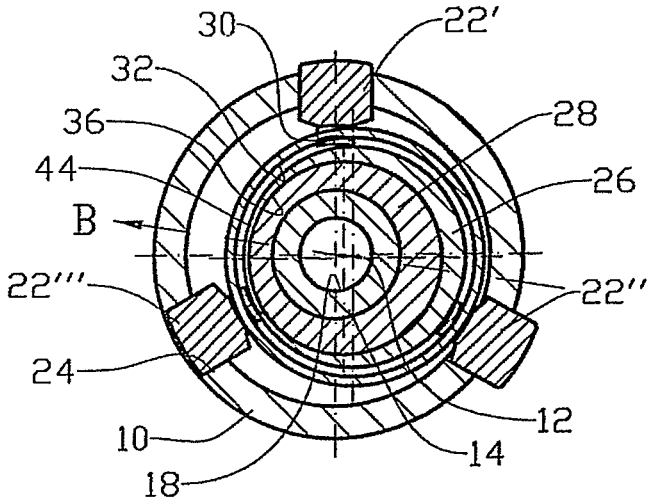
FIG. 7 shows the section IIa-IIa of FIG. 2 after the directional-control apparatus has been adjusted to steer the drilling tool in a direction B.

The second actuator 46 rotates the inner eccentric sleeve 28 and the outer eccentric sleeve 26 and the first actuator 42 around the centre axis 12 relative to the intermediate housing 10. In principle, the intermediate housing 10, which is freely supported, does not rotate, even if the pipe string 2, adapter sleeve 8, mandrel 14 and drill bit 4 are rotating. Thus, the second actuator is used to set the direction in which the steering bodies 22', 22", 22''' are to direct the drill bit, see FIG. 3, in which the drill bit 4 is directed in a direction A, and FIG. 7, in which the drill bit 4 is directed in a direction B.

However, in practice, because of frictional forces and vibrations, the intermediate housing 10 will be dragged along somewhat in the rotation during drilling. The second actuator 46 compensates for this by rotating the eccentric sleeves 26, 28 correspondingly in the opposite direction.

The invention claimed is:

1. A directional-control apparatus for a drilling tool, the directional-control apparatus comprising:

a centre axis;

an intermediate housing, wherein at least one steering body fits into a respective bore in the intermediate housing being adjustable in a radial direction relative to the intermediate housing and against a wall of a borehole, the at least one steering body, at an end portion facing the centre axis, being supported on an outer eccentric sleeve which is rotatably supported on an inner eccentric sleeve which is rotatably supported on a mandrel;

a first electrically operated actuator for rotation of the outer eccentric sleeve; and a second electrically operated actuator for rotation of the inner eccentric sleeve and the outer eccentric sleeve, wherein the drilling tool is steered in a desired direction and at a desired deflection, wherein the at least one steering body is provided with a hook which projects axially relative to the centre axis and into a groove in the outer eccentric sleeve.

2. The directional-control apparatus according to claim 1, wherein the first electrically operated actuator and the second electrically operated actuator are connected to a wire connection to receive control signals and a supply of energy, wherein the wire connection extends to a surface.

3. A directional-control apparatus for a drilling tool, the directional-control apparatus comprising:

a centre axis and an intermediate housing, wherein at least one steering body fits into a bore in the intermediate housing being adjustable in a radial direction relative to the intermediate housing of the directional-control apparatus and against a wall of a borehole, the at least one steering body, at an end portion facing the centre axis, being supported on an outer eccentric sleeve which is rotatably supported on an inner eccentric sleeve which is rotatably supported on a mandrel, wherein the at least one steering body is provided with a hook which projects axially relative to the centre axis and into a groove in the outer eccentric sleeve.

4. The directional-control apparatus according to claim 3, wherein the directional-control apparatus further comprises a first electrically operated actuator for rotation of the outer eccentric sleeve and a second electrically operated actuator for rotation of the inner eccentric sleeve and the outer eccentric sleeve.

5. The directional-control apparatus according to claim 3, wherein the first electrically operated actuator and the second electrically operated actuator are connected to a wire connection to receive control signals and a supply of energy, wherein the wire connection extending to the surface.

* * * * *